US007018962B2

(12) United States Patent
Bloch et al.

(10) Patent No.: US 7,018,962 B2
(45) Date of Patent: Mar. 28, 2006

(54) VISCOSITY INDEX IMPROVER CONCENTRATES

(75) Inventors: Ricardo A. Bloch, Scotch Plains, NJ (US); Jai G. Bansal, Westfield, NJ (US); Dean B. Clarke, Neshanic Station, NJ (US)

(73) Assignee: Infineum International Limited, (GB)

( * ) Notice: Subject to any disclaimer, the term of this patent is extended or adjusted under 35 U.S.C. 154(b) by 313 days.

(21) Appl. No.: 10/459,846

(22) Filed: Jun. 12, 2003

(65) Prior Publication Data

US 2004/0254082 A1 Dec. 16, 2004

(51) Int. Cl.
*C10M 143/00* (2006.01)

(52) U.S. Cl. ..... 508/591; 585/10; 585/12

(58) Field of Classification Search ..... 508/591
See application file for complete search history.

(56) References Cited

U.S. PATENT DOCUMENTS

| | | | | |
|---|---|---|---|---|
| 3,113,986 A | | 12/1963 | Breslow et al. | 260/683.9 |
| RE27,145 E | | 6/1971 | Jones | 260/880 |
| 3,634,595 A | | 1/1972 | Pasquali | 84/1.04 |
| 3,670,054 A | | 6/1972 | De La Mare et al. | 260/880 B |
| 3,700,633 A | | 10/1972 | Wald et al. | 260/880 B |
| 3,897,353 A | * | 7/1975 | Morduchowitz et al. | 508/470 |
| 3,994,815 A | * | 11/1976 | Coleman | 508/591 |
| 5,151,204 A | * | 9/1992 | Struglinski | 508/591 |
| 5,217,636 A | * | 6/1993 | Paboucek | 508/473 |
| 5,460,739 A | * | 10/1995 | Rhodes et al. | 508/591 |
| 6,017,859 A | * | 1/2000 | Rossi et al. | 508/591 |
| 6,034,042 A | | 3/2000 | Rhodes | 508/591 |
| 6,232,279 B1 | | 5/2001 | Steigerwald | 508/591 |
| 6,303,550 B1 | * | 10/2001 | Wedlock et al. | 508/591 |
| 6,468,948 B1 | * | 10/2002 | Rossi et al. | 508/591 |

FOREIGN PATENT DOCUMENTS

| | | |
|---|---|---|
| WO | WO02/10276 A2 | 2/2002 |
| WO | WO04/033606 A1 | 4/2004 |

* cited by examiner

*Primary Examiner*—Ellen M. McAvoy

(57) ABSTRACT

A viscosity index (VI) improver concentrate containing at least one VI improver, from 0 to about 5 mass % of lubricating oil flow improver (LOFI) and diluent oil, wherein the diluent oil has a $kv_{100}$ of at least about 3.0 cSt and a CCS at −35° C. of less than 3700 cPs, and wherein at least about 98 mass % of the concentrate is composed of VI improver, LOFI and diluent oil.

19 Claims, No Drawings

VISCOSITY INDEX IMPROVER CONCENTRATES

FIELD OF THE INVENTION

The invention is directed to viscosity index improver concentrates useful in the formulation of lubricating oil compositions. More specifically, the present invention is directed to viscosity index improver concentrate containing at least one polymeric viscosity index improver, and optionally a polymeric lubricating oil flow improver, in diluent oil, wherein the diluent oil has specified kinematic viscosity and CCS characteristics.

BACKGROUND OF THE INVENTION

Lubricating oil compositions for use in crankcase engine oils comprise a major amount of base stock oil and minor amounts of additives that improve the performance and increase the useful life of the lubricant. Crankcase lubricating oil compositions conventionally contain polymeric components that are used to improve the viscometric performance of the engine oil, i.e., to provide multigrade oils such as SAE 5W-30, 10W-30 and 10W-40. These viscosity performance enhancers, commonly referred to as viscosity index (VI) improvers, include olefin copolymers, polymethacrylates, styrene/hydrogenated diene block and star copolymers and hydrogenated isoprene linear and star polymers.

Olefin copolymers (or OCP) used as VI improvers conventionally comprise copolymers of ethylene, propylene and, optionally, a diene. High ethylene content OCP VI improvers are known to provide reduced lubricating oil resistance to cold engine starting (as measured by "CCS" performance). However, polymer chains having long ethylene sequences have a more crystalline polymer structure. Crystalline polymers have been found, primarily at low temperatures, to interact with waxes in the oil and other OCP chains, which results in uncontrollable increases in low temperature viscosity and, in extreme cases, the gelling of the lubricating oil. These problems have been found to manifest in Ziegler Natta polymerized OCPs containing greater than about 60 mass % polymer derived from ethylene (hereinafter referred to as "high ethylene content", or "crystalline" OCP(s)").

VI improvers are commonly provided to lubricating oil blenders as a concentrate in which the VI improver polymer is diluted in oil to allow, inter alia, for more facile dissolution of the VI improver in the base stock oil. A typical VI improver concentrate can contain as little as 4 mass % active polymer, with the remainder being diluent oil. A typical formulated multigrade crankcase lubricating oil may, depending on the thickening efficiency (TE) of the polymer, require as much as 3 mass % of active VI improver polymer. An additive concentrate providing this amount of polymer can introduce as much as 15 mass %, based on the total mass of the finished lubricant, of diluent oil.

There has been a continued demand for lubricating oil compositions providing improved fuel economy. There has also been a continuous demand for VI improvers that provide improved CCS performance in formulated lubricating oil compositions, without wax and polymer chain interaction (gelling). Much effort has been made in these respects to select the proper base stock oil and to provide a low ethylene content (amorphous) VI improver having improved CCS performance. However, little attention has been paid to the selection of the diluent oil used to form the VI improver concentrate. As the additive industry is highly competitive from a pricing standpoint, and diluent oil represents one of the largest raw material costs to the additive manufacturers, VI improver concentrates have commonly contained the least expensive oil capable of providing suitable handling characteristics; usually a solvent neutral (SN) 100 or SN150 Group 1 oil. Using such conventional VI improver concentrates, the finished lubricant formulator has needed to add a quantity of relatively high quality base stock oil, as a correction fluid, to insure the formulation CCS remained within specification.

As lubricating oil performance standards have become more stringent, there has been a continuing need to identify components capable of conveniently and cost effectively improving overall lubricant performance. Therefore, it would be advantageous to be able to provide a VI improver concentrate that delivers improved cold temperature performance, regardless of the VI improver employed, without requiring use of correction fluids.

SUMMARY OF THE INVENTION

In accordance with a first aspect of the invention, there is provided a viscosity index (VI) improver concentrate comprising at least one polymeric VI improving material, optionally a polymeric lubricating oil flow improver (LOFI) material, and diluent oil, wherein the diluent oil has a kinematic viscosity at 100° C. ($kv_{100}$) of at least 3.0 and CCS at −35° C. of less than 3700 cPs, and wherein at least 98 mass % of said concentrate consists essentially of VI improving material, LOFI material and diluent oil.

In accordance with a second aspect of the invention, there is provided a (VI) improver concentrate, as in the first aspect, wherein the diluent oil has a Noack volatility of less than 40 mass %.

In accordance with a third aspect of the invention, there is provided a VI improver concentrate, as in the first or second aspect, wherein the concentrate has a kinematic viscosity at 100° C. ($kv_{100}$) of from about 300 to about 2500 cSt.

In accordance with a fourth aspect of the invention, there is provided a VI improver concentrate, as in the first, second or third aspect, wherein the VI improver is a copolymer of ethylene and another α-olefin (OCP).

In accordance with a fifth aspect of the invention, there is provided a VI improver concentrate, as in the fourth aspect, wherein the VI improver is an amorphous OCP.

Other and further objects, advantages and features of the present invention will be understood by reference to the following specification.

DETAILED DESCRIPTION OF THE INVENTION

VI improvers useful in the practice of the invention include ethylene-α-olefin copolymers (OCP) synthesized from ethylene monomer and at least one other α-olefin comonomer. The average ethylene content of OCP useful in the present invention can be as low as about 20% on a mass basis; preferably about 25%; more preferably about 30%. The maximum ethylene content can be about 90% on a mass basis; preferably about 85%; most preferably about 80%. OCP intended for use as viscosity modifiers typically comprise from about 35 to 75 wt. % ethylene but more preferably are "amorphous" or substantially amorphous copolymers comprising less than about 60 mass %, (e.g. 40 to 56 mass %) ethylene. Crystalline ethylene-α-olefin copolymers are defined as those comprising greater than about 60 mass ethylene (e.g. from about 60 to about 90 mass % ethylene). Conversely, amorphous or substantially amorphous ethylene-α-olefin copolymers used as VI improving materials typically comprise from about 25 to about 60 mass % ethylene; preferably from about 30 to about 60 mass % ethylene; more preferably from about 35 to about 60 mass % ethylene. Ethylene content can be measured by ASTM-D3900 for ethylene-propylene copolymers containing between 35 mass % and 85 mass % ethylene. Above 85 mass %, ASTM-D2238 can be used to obtain methyl group concentration, which is related to percent ethylene in an unambiguous manner for ethylene-propylene copolymers. When comonomers other than propylene are employed, no ASTM tests covering a wide range of ethylene contents are available; however, proton and carbon-13 nuclear magnetic resonance spectroscopy can be employed to determine the composition of such polymers. These are absolute techniques requiring no calibration when operated such that all nuclei of a given element contribute equally to the spectra. For ethylene content ranges not covered by the ASTM tests for ethylene-propylene copolymers, as well as for any ethylene-propylene copolymers, the aforementioned nuclear magnetic resonance methods can also be used.

As noted, the ethylene-α-olefin copolymers are comprised of ethylene and at least one other α-olefin. The "other" α-olefins typically include those containing 3 to 18 carbon atoms, e.g., propylene, butene-1, pentene-1, etc. Preferred are α-olefins having 3 to 6 carbon atoms, particularly for economic reasons. The most preferred OCP are those comprised of ethylene and propylene.

As is well known to those skilled in the art, copolymers of ethylene and higher alpha-olefins such as propylene can optionally include other polymerizable monomers. Typical of these other monomers are non-conjugated dienes such as the following non-limiting examples:

a. straight chain acyclic dienes such as: 1,4-hexadiene; 1,6-octadiene;
b. branched chain acyclic dienes such as: 5-methyl-1,4-hexadiene; 3,7-dimethyl-1,6-octadiene; 3,7-dimethyl-1,7-octadiene and the mixed isomers of dihydromycene and dihydroocinene;
c. single ring alicyclic dienes such as: 1,4-cyclohexadiene; 1,5-cyclooctadiene; and 1,5-cyclododecadiene; and
d. multi-ring alicyclic fused and bridged ring dienes such as: tetrahydroindene; methyltetrahydroindene; dicyclopentadiene; bicyclo-(2,2,1)-hepta-2,5-diene; alkenyl, alkylidene, cycloalkenyl and cycloalkylidene norbornenes such as 5-methylene-2-norbornene (MNB), 5-ethylidene-2-norbornene (ENB), 5-propylene-2-norbornene, 5isopropylidene-2-norbornene, 5-(4-cyclopentenyl)-2-norbornene; 5-cyclohexylidene-2-norbornene.

Of the non-conjugated dienes typically used to prepare these copolymers, dienes containing at least one of the double bonds in a strained ring are preferred. The most preferred diene is 5-ethylidene-2-norbornene (ENB). When present, the amount of diene (on a weight basis) in the copolymer can be from greater than 0% to about 20%; preferably from greater than 0% to about 15%; most preferably greater than 0% to about 10%.

The molecular weight of OCP useful in accordance with the present invention can vary over a wide range since ethylene copolymers having number-average molecular weights ($M_n$) as low as about 2,000 can affect the viscosity properties of an oleaginous composition. The preferred minimum $M_n$ is about 10,000; the most preferred minimum is about 20,000. The maximum $M_n$ can be as high as about 12,000,000; the preferred maximum is about 1,000,000; the most preferred maximum is about 750,000. An especially preferred range of number-average molecular weight for OCP useful in the present invention is from about 15,000 to about 500,000; preferably from about 20,000 to about 250,000; more preferably from about 25,000 to about 150,000. The term "number average molecular weight", as used herein, refers to the number average weight as measured by Gel Permeation Chromatography ("GPC") with a polystyrene standard.

Other VI improvers useful in the practice of the invention include homopolymers and copolymers of diolefins containing from 4 to about 12 carbon atoms, preferably from 8 to about 16 carbon atoms, such as 1,3-butadiene, isoprene, piperylene, methylpentadiene, phenylbutadiene, 3,4-dimethyl-1,3-hexadiene, 4,5-diethyl-1,3-octadiene, and copolymers of one or more conjugated diolefins and one or more monoalkenyl aromatic hydrocarbons containing from 8 to about 16 carbon atoms such as aryl-substituted styrenes, alkoxy-substituted styrenes, vinyl naphthalene, alkyl-substituted vinyl naphthalenes and the like. Such polymers and copolymers include random polymers, tapered polymers and block copolymers and may be of a star or linear structure.

Linear block copolymers useful in the practice of the present invention may be represented by the following general formula:

$$A_z\text{-}(B\text{-}A)_y\text{-}B_x$$

wherein:

A is a polymeric block comprising predominantly monoalkenyl aromatic hydrocarbon monomer units;

B is a polymeric block comprising predominantly conjugated diolefin monomer units;

x and z are, independently, a number equal to 0 or 1; and y is a whole number ranging from 1 to about 15.

Useful tapered linear block copolymers may be represented by the following general formula:

$$A\text{-}A/B\text{-}B$$

wherein:

A is a polymeric block comprising predominantly monoalkenyl aromatic hydrocarbon monomer units;

B is a polymeric block comprising predominantly conjugated diolefin monomer units; and A/B is a tapered segment containing both monoalkenyl aromatic hydrocarbon and conjugated diolefin units.

Radial or star polymers may be represented, generally, by the following general formula:

$$(B_x\text{-}(A\text{-}B)_y\text{-}A_z)_n\text{-}C;\ \text{and}$$

$$(B'_x\text{-}(A\text{-}B)_y\text{-}A_z)_{n'}\text{-}C(B')_{n''}$$

wherein:

A, B, x, y and z are as previously defined;

n is a number from 3 to 30;

C is the core of the radial polymer formed with a polyfunctional coupling agent;

B' is a polymeric block comprising predominantly conjugated diolefin units, which B'may be the same or different from B; and n' and n" are integers representing the number of each type of arm and the sum of n' and n" will be a number from 3 to 30.

As used herein in connection with polymer block composition, predominantly means that the specified monomer or monomer type which is the principle component in that polymer block is present in an amount of at least 85% by weight of the block.

Polymers prepared with diolefins will contain ethylenic unsaturation, and such polymers are preferably hydrogenated. When the polymer is hydrogenated, the hydrogenation may be accomplished using any of the techniques known in the prior art. For example, the hydrogenation may be accomplished such that both ethylenic and aromatic unsaturation is converted (saturated) using methods such as those taught, for example, in U.S. Pat. Nos. 3,113,986 and 3,700,633 or the hydrogenation may be accomplished selectively such that a significant portion of the ethylenic unsaturation is converted while little or no aromatic unsaturation is converted as taught, for example, in U.S. Pat. Nos. 3,634,595; 3,670,054; 3,700,633 and Re 27,145. Any of these methods can also be used to hydrogenate polymers containing only ethylenic unsaturation and which are free of aromatic unsaturation.

Polymeric VI improvers may include mixtures of linear polymers as disclosed above, but having different molecular weights and/or different alkenyl aromatic contents as well as mixtures of star polymers having different molecular weights and/or different alkenyl aromatic contents. Alternatively, mixtures of star polymers and linear polymers having different molecular weights and/or different alkenyl aromatic contents may be used. The use of two or more different polymers may be preferred to a single polymer depending on the Theological properties the product is intended to impart when used to produce formulated engine oil. Mixtures of, for example, OCP and star polymers are also known.

In general, number average molecular weights of between about 200,000 and about 1,500,000 are acceptable, and between about 350,000 and about 900,000 are preferred, and between about 350,000 and about 800,000 are most preferred for the base polymer when the base polymer is a star-configuration hydrogenated polymer of one or more conjugated olefins or a star configuration polymer of one or more alpha olefins. When the base polymer is a star configuration copolymer containing more than about 3% by weight of monoalkenyl arenes, the number average molecular weight is preferably between about 350,000 and about 800,000.

When the base polymer is a copolymer of monoalkenyl arene and polymerized alpha olefins, hydrogenated polymerized diolefins or combinations thereof, the amount of monoalkenyl arene in the base polymer is preferably between about 5% and about 40% by weight of the base polymer. For such polymers, number average molecular weights between about 85,000 and about 300,000 are acceptable.

Useful copolymers of this type include those prepared in bulk, suspension, solution or emulsion. As is well known, polymerization of monomers to produce hydrocarbon polymers may be accomplished using free-radical, cationic and anionic initiators or polymerization catalysts, such as transition metal catalysts used for Ziegler-Natta and metallocene type catalysts.

Optionally, the VI improvers used in the practice of the invention can be provided with nitrogen-containing functional groups that impart dispersant capabilities to the VI improver. One trend in the industry has been to use such "multifunctional" VI improvers in lubricants to replace some or all of the dispersant. Nitrogen-containing functional groups can be added to a polymeric VI improver by grafting a nitrogen- or hydroxyl- containing moiety, preferably a nitrogen-containing moiety, onto the polymeric backbone of the VI improver (functionalizing). Processes for the grafting of a nitrogen-containing moiety onto a polymer are known in the art and include, for example, contacting the polymer and nitrogen-containing moiety in the presence of a free radical initiator, either neat, or in the presence of a solvent. The free radical initiator may be generated by shearing (as in an extruder) or heating a free radical initiator precursor, such as hydrogen peroxide.

The amount of nitrogen-containing grafting monomer will depend, to some extent, on the nature of the substrate polymer and the level of dispersancy required of the grafted polymer. To impart dispersancy characteristics to both star and linear copolymers, the amount of grafted nitrogen-containing monomer is suitably between about 0.4 and about 2.2 wt. %, preferably from about 0.5 to about 1.8 wt. %, most preferably from about 0.6 to about 1.2 wt. %, based on the total weight of grafted polymer.

Methods for grafting nitrogen-containing monomer onto polymer backbones, and suitable nitrogen-containing grafting monomers are known and described, for example, in U.S. Pat. No. 5,141,996, WO 98/13443, WO 99/21902, U.S. Pat. No. 4,146,489, U.S. Pat. No. 4,292,414, and U.S. Pat. No. 4,506,056. (See also *J Polymer Science*, Part A: Polymer Chemistry, Vol. 26, 1189–1198 (1988); *J. Polymer Science*, Polymer Letters, Vol. 20, 481–486 (1982) and *J. Polymer Science*, Polymer Letters, Vol. 21, 23–30 (1983), all to Gaylord and Mehta and *Degradation and Cross-linking of Ethylene-Propylene Copolymer Rubber on Reaction with Maleic Anhydride and/or Peroxides; J. Applied Polymer Science*, Vol. 33, 2549–2558 (1987) to Gaylord, Mehta and Mehta.

Oils of lubricating viscosity useful as the diluents of the present invention may be selected from natural lubricating oils, synthetic lubricating oils and mixtures thereof.

Natural oils include animal oils and vegetable oils (e.g., castor oil, lard oil); liquid petroleum oils and hydro-refined, solvent-treated or acid-treated mineral oils of the paraffinic, naphthenic and mixed paraffinic-naphthenic types. Oils of lubricating viscosity derived from coal or shale also serve as useful base oils.

Synthetic lubricating oils include hydrocarbon oils and halo-substituted hydrocarbon oils such as polymerized and interpolymerized olefins (e.g., polybutylenes, polypropylenes, propylene-isobutylene copolymers, chlorinated polybutylenes, poly(1-hexenes), poly(1-octenes), poly(1-decenes)); alkylbenzenes (e.g., dodecylbenzenes, tetradecylbenzenes, dinonylbenzenes, di(2-ethylhexyl)benzenes); polyphenyls (e.g., biphenyls, terphenyls, alkylated polyphenols); and alkylated diphenyl ethers and alkylated diphenyl sulfides and derivative, analogs and homologs thereof.

Alkylene oxide polymers and interpolymers and derivatives thereof where the terminal hydroxyl groups have been modified by esterification, etherification, etc., constitute another class of known synthetic lubricating oils. These are exemplified by polyoxyalkylene polymers prepared by polymerization of ethylene oxide or propylene oxide, and the alkyl and aryl ethers of polyoxyalkylene polymers (e.g., methyl-polyiso-propylene glycol ether having a molecular weight of 1000 or diphenyl ether of poly-ethylene glycol having a molecular weight of 1000 to 1500); and mono- and polycarboxylic esters thereof, for example, the acetic acid esters, mixed $C_3$–$C_8$ fatty acid esters and $C_{13}$ Oxo acid diester of tetraethylene glycol.

Another suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids) with a variety of alcohols (e.g., butyl alcohol, hexyl alcohol, dodecyl alcohol, 2-ethylhexyl alcohol, ethylene glycol, diethylene glycol monoether, propylene glycol). Examples of such esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from $C_5$ to $C_{12}$ monocarboxylic acids and polyols and polyol esters such as neopentyl glycol, trimethylolpropane, pentaerythritol, dipentaerythritol and tripentaerythritol.

Silicon-based oils such as the polyalkyl-, polyaryl-, polyalkoxy- or polyaryloxysilicone oils and silicate oils comprise another useful class of synthetic lubricants; such oils include tetraethyl silicate, tetraisopropyl silicate, tetra-(2-ethylhexyl)silicate, tetra-(4-methyl-2-ethylhexyl)silicate, tetra-(p-tert-butyl-phenyl) silicate, hexa-(4-methyl-2-ethylhexyl)disiloxane, poly(methyl)siloxanes and poly(methylphenyl)siloxanes. Other synthetic lubricating oils include liquid esters of phosphorous-containing acids (e.g., tricresyl phosphate, trioctyl phosphate, diethyl ester of decylphosphonic acid) and polymeric tetrahydrofurans.

The diluent oil may comprise a Group I, Group II, Group III, Group IV or Group V oil or blends of the aforementioned oils. The diluent oil may also comprise a blend of a Group I oil and one or more of Group II, Group III, Group IV or Group V oil. Preferably, from an economic standpoint, the diluent oil is a mixture of a Group I oil and one or more a Group II, Group m, Group IV or Group V oil, more preferably a mixture of a Group I oil and one or more Group II or Group III oil.

Definitions for the oils as used herein are the same as those found in the American Petroleum Institute (API) publication "Engine Oil Licensing and Certification System", Industry Services Department, Fourteenth Edition, December 1996, Addendum 1, December 1998. Said publication categorizes oils as follows:

a) Group I oils contain less than 90 percent saturates and/or greater than 0.03 percent sulfur and have a viscosity index greater than or equal to 80 and less than 120 using the test methods specified in Table 1.

b) Group II oils contain greater than or equal to 90 percent saturates and less than or equal to 0.03 percent sulfur and have a viscosity index greater than or equal to 80 and less than 120 using the test methods specified in Table 1. Although not a separate Group recognized by the API, Group II oils having a viscosity index greater than about 110 are often referred to as "Group II+" oils.

c) Group III oils contain greater than or equal to 90 percent saturates and less than or equal to 0.03 percent sulfur and have a viscosity index greater than or equal to 120 using the test methods specified in Table 1.

d) Group IV oils are polyalphaolefins (PAO).

e) Group V oils are all other base stocks not included in Group I, II, III, or IV.

TABLE 1

| Property | Test Method |
|---|---|
| Saturates | ASTM D2007 |
| Viscosity Index | ASTM D2270 |
| Sulfur | ASTM D4294 |

As noted supra, diluent oil useful in the practice of the invention has a CCS at −35° C. of less than 3700 cPs, such as less than 3300 cPs, preferably less than 3000 cPs, such as less than 2800 cPs and more preferably less than 2500 cPs, such as less than 2300 cPs.

Diluent oil useful in the practice of the invention also has a kinematic viscosity at 100° C. ($kv_{100}$) of at least 3.0 cSt (centistokes), such as from about 3 cSt. to 5 cSt., especially from about 3 cSt. to 4 cSt., such as from about 3.4 to 4 cSt. More active polymer may be required to provide suitable viscometrics when lower viscosity diluent oil is used.

The diluent oil preferably has a saturate content of at least 65%, more preferably at least 75%, such as at least 85%. Most preferably, the diluent oil has a saturate content of greater than 90%. Preferably, the diluent oil has a sulfur content of less than 1%, preferably less than 0.6%, more preferably less than 0.3%, by mass, such as 0 to 0.3% by mass Preferably the volatility of the diluent oil, as measured by the Noack test (ASTM D5880), is less than or equal to about 40%, such as less than or equal to about 35%, preferably less than or equal to about 32%, such as less than or equal to about 28%, more preferably less than or equal to about 16%. Using a diluent oil having a greater volatility makes it difficult to provide a formulated lubricant having a Noack volatility of less than or equal to 15%. Formulated lubricants having a higher level of volatility may display fuel economy debits. Preferably, the viscosity index (VI) of the diluent oil is at least 85, preferably at least 100, most preferably from about 105 to 140.

The VI improver concentrate may also be used to provide a polymeric lubricating oil flow improver (LOFI), also commonly referred to as pour point depressant (PPD). The LOFI is used to lower the minimum temperature at which the fluid will flow or can be poured and such additives are well known. Typical of such additives are $C_8$ to $C_{18}$ dialkyl fumarate/vinyl acetate copolymers, polymethacrylates and styrene/maleic anhydride ester copolymers.

The VI improver concentrates of the present invention can contain from about 4 to about 50 mass %, such as from about 5 to about 25 mass %, preferably from about 6 to about 20 mass %, such as from about 7 to about 15 mass % of VI improver and from about 0 to about 5 mass % of LOFI, with the remainder comprising diluent. At least about 98 mass %, preferably at least about 99.5 mass % of the VI improver concentrate consists essentially of VI improver, LOFI and diluent oil.

The VI improver concentrates of the present invention can be prepared by dissolving the VI improver polymer(s), and optional LOFI, in the diluent oil using well known techniques. When dissolving a solid VI improver polymer to form a concentrate, the high viscosity of the polymer can cause poor diffusivity in the diluent oil. To facilitate dissolution, it is common to increase the surface are of the polymer by, for example, pelletizing, chopping, grinding or pulverizing the polymer. The temperature of the diluent oil can also be increased by heating using, for example, steam or hot oil. When the diluent temperature is greatly increased (such as to above 100° C.), heating should be conducted under a blanket of inert gas (e.g., $N_2$ or $CO_2$). The temperature of the polymer may also be raised using, for example, mechanical energy imparted to the polymer in an extruder or masticator. The polymer temperature can be raised above 150° C.; the polymer temperature is preferably raised under a blanket of inert gas. Dissolving of the polymer may also be aided by agitating the concentrate, such as by stirring or agitating (in either the reactor or in a tank), or by using a recirculation pump. Any two or more of the foregoing techniques can also be used in combination. Concentrates can also be formed by exchanging the polymerization solvent (usually a volatile hydrocarbon such as, for example, propane, hexane or cyclohexane) with oil. This exchange can be accomplished by, for example, using a distillation column to assure that substantially none of the polymerization solvent remains.

The concentrates of the invention are principally used in the formulation of crankcase lubricating oils for passenger car and heavy duty diesel engines (fully formulated lubricants), which fully formulated lubricants comprise a major amount of an oil of lubricating viscosity and a viscosity index (VI) improver as described above, in an amount effective to meet the requirements of the selected grade. Such fully formulated lubricants may contain the VI improver provided by the concentrate of the invention in an amount of from about 0.1 mass % to about 3 mass %, preferably from about 0.2 mass % to about 2 mass %, more preferably from about 0.3 mass % to about 1.5 mass %, stated as mass percent active ingredient (AI) based on the total mass of the formulated lubricant. The amount of VI improver needed to provide the fully formulated lubricant with the required viscometric properties is further a function of the TE of the VI improver employed.

In addition to the VI improver and LOFI, a fully formulated lubricant can generally contain a number of other performance improving additives selected from ashless dispersants, metal-containing, or ash-forming detergents, antiwear agents, oxidation inhibitors or antioxidants, friction modifiers and fuel economy agents, and stabilizers or emulsifiers. Conventionally, when formulating a lubricant, the VI improver and/or VI improver and LOFI, will be provided to the formulator in one concentrated package, and combinations of the remaining additives will provided in one or more additional concentrated packages, oftentimes referred to as DI (dispersant-inhibitor) packages.

Ashless dispersants maintain in suspension oil insolubles resulting from oxidation of the oil during wear or combustion. They are particularly advantageous for preventing the precipitation of sludge and the formation of varnish, particularly in gasoline engines.

Metal-containing or ash-forming detergents function both as detergents to reduce or remove deposits and as acid neutralizers or rust inhibitors, thereby reducing wear and corrosion and extending engine life. Detergents generally comprise a polar head with a long hydrophobic tail, with the polar head comprising a metal salt of an acidic organic compound. The salts may contain a substantially stoichiometric amount of the metal in which case they are usually described as normal or neutral salts, and would typically have a total base number or TBN (as can be measured by ASTM D2896) of from 0 to 80. A large amount of a metal base may be incorporated by reacting excess metal compound (e.g., an oxide or hydroxide) with an acidic gas (e.g., carbon dioxide). The resulting overbased detergent comprises neutralized detergent as the outer layer of a metal base (e.g. carbonate) micelle. Such overbased detergents may have a TBN of 150 or greater, and typically will have a TBN of from 250 to 450 or more.

Dihydrocarbyl dithiophosphate metal salts are frequently used as antiwear and antioxidant agents. The metal may be an alkali or alkaline earth metal, or aluminum, lead, tin, molybdenum, manganese, nickel or copper. The zinc salts are most commonly used in lubricating oil and may be prepared in accordance with known techniques by first forming a dihydrocarbyl dithiophosphoric acid (DDPA), usually by reaction of one or more alcohol or a phenol with $P_2S_5$ and then neutralizing the formed DDPA with a zinc compound. For example, a dithiophosphoric acid may be made by reacting mixtures of primary and secondary alcohols. Alternatively, multiple dithiophosphoric acids can be prepared where the hydrocarbyl groups on one are entirely secondary in character and the hydrocarbyl groups on the others are entirely primary in character. To make the zinc salt, any basic or neutral zinc compound could be used but the oxides, hydroxides and carbonates are most generally employed. Commercial additives frequently contain an excess of zinc due to the use of an excess of the basic zinc compound in the neutralization reaction.

Oxidation inhibitors or antioxidants reduce the tendency of mineral oils to deteriorate in service. Oxidative deterioration can be evidenced by sludge in the lubricant, varnish-like deposits on the metal surfaces, and by viscosity growth. Such oxidation inhibitors include hindered phenols, alkaline earth metal salts of alkylphenolthioesters having preferably $C_5$ to $C_{12}$ alkyl side chains, calcium nonylphenol sulfide, oil soluble phenates and sulfurized phenates, phosphosulfurized or sulfurized hydrocarbons, phosphorous esters, metal thiocarbamates, oil soluble copper compounds as described in U.S. Patent No. 4,867,890, and molybdenum-containing compounds and aromatic amines.

Known friction modifiers include oil-soluble organo-molybdenum compounds. Such organo-molybdenum friction modifiers also provide antioxidant and antiwear credits to a lubricating oil composition. As an example of such oil soluble organo-molybdenum compounds, there may be mentioned the dithiocarbamates, dithiophosphates, dithiophosphinates, xanthates, thioxanthates, sulfides, and the like, and mixtures thereof. Particularly preferred are molybdenum dithiocarbamates, dialkyldithiophosphates, alkyl xanthates and alkylthioxanthates.

Other known friction modifying materials include glyceryl monoesters of higher fatty acids, for example, glyceryl mono-oleate; esters of long chain polycarboxylic acids with diols, for example, the butane diol ester of a dimerized unsaturated fatty acid; oxazoline compounds; and alkoxylated alkyl-substituted mono-amines, diamines and alkyl ether amines, for example, ethoxylated tallow amine and ethoxylated tallow ether amine.

Foam control can be provided by an antifoamant of the polysiloxane type, for example, silicone oil or polydimethyl siloxane.

Some of the above-mentioned additives can provide a multiplicity of effects; thus for example, a single additive may act as a dispersant-oxidation inhibitor. This approach is well known and need not be further elaborated herein.

It may also be necessary to include an additive which maintains the stability of the viscosity of the blend. Thus, although polar group-containing additives achieve a suitably low viscosity in the pre-blending stage it has been observed that some compositions increase in viscosity when stored for prolonged periods. Additives which are effective in controlling this viscosity increase include the long chain hydrocarbons functionalized by reaction with mono- or dicarboxylic acids or anhydrides which are used in the preparation of the ashless dispersants as hereinbefore disclosed.

Representative effective amounts of such additional additives, when used in crankcase lubricants, are listed below:

| ADDITIVE | Mass % (Broad) | Mass % (Preferred) |
|---|---|---|
| Ashless Dispersant | 0.1–20 | 1–8 |
| Metal Detergents | 0.1–15 | 0.2–9 |
| Corrosion Inhibitor | 0–5 | 0–1.5 |
| Metal Dihydrocarbyl Dithiophosphate | 0.1–6 | 0.1–4 |
| Antioxidant | 0–5 | 0.01–2 |
| Pour Point Depressant | 0.01–5 | 0.01–1.5 |
| Antifoaming Agent | 0–5 | 0.001–0.15 |
| Supplemental Antiwear Agents | 0–1.0 | 0–0.5 |
| Friction Modifier | 0–5 | 0–1.5 |
| Basestock | Balance | Balance |

This invention will be further understood by reference to the following examples. In the following Examples, the properties of certain VI improvers are described using certain terms of art, defined below. All weight percents expressed herein (unless otherwise indicated) are based on active ingredient (AI) content of the additive, and/or upon the total weight of any additive-package, or formulation which will be the sum of the Al weight of each additive plus the weight of total oil and/or diluent.

"Shear Stability Index (SSI)" measures the ability of polymers used as V.I. improvers in crankcase lubricants to maintain thickening power during use. SSI is indicative of the resistance of a polymer to degradation under service conditions. The higher the SSI, the less stable the polymer, i.e., the more susceptible it is to degradation. SSI is defined as the percentage of polymer-derived viscosity loss and is calculated as follows:

$$SSI = 100 \times \frac{kv_{fresh} - kv_{after}}{kv_{fresh} - kv_{oil}}$$

wherein $kv_{fresh}$ is the kinematic viscosity of the polymer-containing solution before degradation and $kv_{after}$ is the kinematic viscosity of the polymer-containing solution after degradation. SSI is conventionally determined using ASTM D6278-98 (known as the Kurt-Orban (KO) or DIN bench test). The polymer under test is dissolved in suitable base oil (for example, solvent extracted 150 neutral) to a relative viscosity of 2 to 3 centistokes at 100° C. and the resulting fluid is pumped through the testing apparatus specified in the ASTM D6278-98 protocol.

"Thickening Efficiency (TE)" is representative of a polymers ability to thicken oil per unit mass and is defined as:

$$TE = \frac{2}{c \ln 2} \ln\left(\frac{kv_{oil+polymer}}{kv_{oil}}\right)$$

wherein c is polymer concentration (grams of polymer/100 grams solution), $kv_{oil+polymer}$ is kinematic viscosity of the polymer in the reference oil, and $kv_{oil}$ is kinematic viscosity of the reference oil.

"Cold Cranking Simulator (CCS)" is a measure of the cold-cranking characteristics of crankcase lubricants and is conventionally determined using a technique described in ASTM D5293-92.

"Crystallinity" in ethylene-alph-olefin polymers can be measured using X-ray techniques known in the art as well as by the use of a differential scanning calorimetry (DSC) test. DSC can be used to measure crystallinity as follows: a polymer sample is annealed at room temperature (e.g., 20–25° C.) for at least 24 hours before the measurement. Thereafter, the sample is first cooled to −100° C. from room temperature, and then heated to 150 C at 10° C./min. Crystallinity is calculated as follows:

$$\%\ Crystallinity = \left(\sum \Delta H\right) \times x_{methylene} \times \frac{14}{4110} \times 100\%,$$

wherein ΣΔH (J/g) is the sum of the heat absorbed by the polymer above its glass transition temperature, $x_{methylene}$ is the molar fraction of ethylene in the polymer calculated, e.g., from proton NMR data, 14 (g/mol) is the molar mass of a methylene unit, and 4110 (J/mol) is the heat of fusion for a single crystal of polyethylene at equilibrium.

EXAMPLES

Diluent oils used in the following Examples are characterized in Table 2. VI improvers used in the following Examples are characterized in Table 3, below:

TABLE 2

Diluent Oils and Diluent Oil Blends

| Dil. Oil No. | Type | Noack | $kv_{100}$ | CCS @ −35° C. |
|---|---|---|---|---|
| Oil 1 | Group I | 27 | 4.0 | 5926 |
| Oil 2 | Group I | 19.8 | 5.2 | 18468 |
| Oil 3 | Group II | 26.2 | 4.1 | 5033 |
| Oil 4 | Group II | 16.9 | 4.3 | 3332 |
| Oil 5 | Group II+ | 14.7 | 4.5 | 5948 |
| Oil 6 | Group III | 15.4 | 4.2 | 2841 |
| Oil 7 | Group II+ blend | 26.2 | 4.0 | 3317 |
| Oil 8 | Group III/Group II+ blend | 24.5 | 3.8 | 2136 |
| Oil 9 | Group II+ blend | 22.4 | 3.6 | 1038 |
| Oil 10 | Group II+/Group I blend | 27.6 | 3.5 | 1486 |
| Oil 11 | Group I | 92.8 | 3.1 | 1840 |
| Oil 12 | Group I/Group III blend | 20.8 | 3.5 | 1854 |

TABLE 3

VI Improvers

| VI Improver No. | Type | Ethylene Content* | $M_n$ | $M_n/M_w$ | SSI |
|---|---|---|---|---|---|
| VII 1 | Amorphous OCP | 49.4 mass % | 55,000 | 2.0 | 35 |
| VII 2 | Amorphous OCP | 49.4 mass % | 97,500 | 2.0 | 50 |

*mass % of polymer derived from ethylene monomer, based on total mass of polymer

Example 1

Concentrates containing 9 mass % of polymer were prepared from the above diluent oils and VI improver polymers, and used in combination with a common DI package to formulate lubricants of varying grades using the indicated base stock oils. The formulated lubricants were of the type suitable for use as either a passenger car motor oil (PCMO) or heavy duty diesel (HDD) crankcase lubricant and had a Noack volatility below 15%. The CCS properties of the fully formulated lubricants were determined and the results provided.

TABLE 4

| VII No. | Dil. Oil No. | 5W30 PCMO Group II+ Basestock CCS @ −30° C. (cP) | 10W40 PCMO Group I/II Basestock Blend CCS @ −25° C. (cP) | 10W30 PCMO Group I Basestock CCS @ −25° C. (cP) |
|---|---|---|---|---|
| 1 | 1 | 5685 | 7129 | 6564 |
| 1 | 5 | 5699 | 6872 | — |
| 1 | 7 | 5514 | 6578 | — |
| 1 | 8 | — | — | 6179 |

As shown, for each of the noted grades, the formulated lubricant prepared using the concentrate containing a diluent oil of the invention (Oil. Nos. 7 and 8) provided improved CCS performance using an amorphous OCP VI improver.

Example 2

Concentrates containing 9 mass % of VII polymer 1 were prepared from the above diluent oils and used, in combination with a common DI package and a base stock blend of Group I and Group II base stock oil, to formulate 10W30 grade HDD crankcase lubricants. The CCS, Noack volatility and kinematic viscosities of the fully formulated lubricants were determined and the results provided.

TABLE 5

| Dil. Oil No. | CCS @ −25° C. (cP) | Predicted Noack (mass %) | $kv_{100}$ |
|---|---|---|---|
| 1 | 6292 | 15.9 | 10.72 |
| 6 | 6033 | 15.5 | 10.78 |

In the noted formulations, the concentrate containing the claimed diluent oil (Oil 6) provided improved CCS with an amorphous OCP VI improver, with comparable Noack volatility and kinematic viscosity characteristics.

Example 3

Concentrates containing 9 mass % of VII polymer 1 were prepared using the above diluent oils and used, in combination with a common DI package and a Group II+base stock oil, to formulate 5W30 grade PCMO crankcase lubricants. The amount of VI improver concentrate was adjusted such that the formulated lubricants all had a Noack volatility no greater than 15%. The CCS, and kinematic viscosities of the fully formulated lubricants were determined and the results provided.

TABLE 6

| Dil. Oil No. | CCS @ −25° C. (cP) | Predicted Noack (mass %) | $kv_{100}$ |
|---|---|---|---|
| 1 | 6193 | 15.0 | 10.63 |
| 7 | 6032 | 14.8 | 10.47 |

TABLE 6-continued

| Dil. Oil No. | CCS @ −25° C. (cP) | Predicted Noack (mass %) | $kv_{100}$ |
|---|---|---|---|
| 6 | 5826 | 15.0 | 10.61 |
| 6 | 5931 | 14.5 | 10.67 |

In the noted formulations, the concentrate containing the claimed diluent oils (Oils 6 and 7) provided improved CCS with an amorphous OCP VI improver, at comparable Noack volatility and with similar kinematic viscosity characteristics.

Example 4

Concentrates containing 9 mass % of VII polymer 1 were prepared from the above diluent oils and used in combination with a DI package and a Group I base stock oil, to formulate 10W30 grade PCMO crankcase lubricants. The CCS, and kinematic viscosities of the fully formulated lubricants were determined and the results provided.

TABLE 7

| Dil. Oil No. | CCS @ −25° C. (cP) | Predicted Noack (mass %) | $kv_{100}$ |
|---|---|---|---|
| 1 | 6554 | 15.5 | 10.53 |
| 6 | 6268 | 15.0 | 10.50 |
| 11 | 6198 | 21.5 | 10.32 |
| 8 | 6179 | 15.5 | 10.43 |

In the noted formulations, the concentrate containing the claimed diluent oils (Oils 6, 8 and 11) provided improved CCS with an amorphous OCP VI improver and similar kinematic viscosity characteristics. However, as the results further show, when using a diluent oil having a Noack viscosity above 40% (Dil. Oil 11), it may not be possible to blend a formulated oil within the desired grade having an acceptable Noack volatility.

The disclosures of all patents, articles and other materials described herein are hereby incorporated, in their entirety, into this specification by reference. A description of a composition comprising, consisting of, or consisting essentially of multiple specified components, as presented herein and in the appended claims, should be construed to also encompass compositions made by admixing said multiple specified components. The principles, preferred embodiments and modes of operation of the present invention have been described in the foregoing specification. What applicants submit is their invention, however, is not to be construed as limited to the particular embodiments disclosed, since the disclosed embodiments are regarded as illustrative rather than limiting. Changes may be made by those skilled in the art without departing from the spirit of the invention.

What is claimed is:

1. A viscosity index (VI) improver concentrate comprising at least one VI improver, from 0 to about 5 mass % of lubricating oil flow improver (LOFI) and diluent oil, wherein the diluent oil has a $kv_{100}$ of at least about 3.0 cSt and a CCS at −35° C. of less than 3700 cPs, wherein at least about 98 mass % of said concentrate consists essentially of said VI improver, said LOFI and said diluent oil, and wherein the diluent oil is a Group II, Group III or Group IV oil, a mixture thereof, or a mixture of a Group I oil and at least one Group II, Group III or Group IV oil.

2. A concentrate of claim 1, wherein said diluent oil has a Noack volatility of less than about 40 mass %.

3. A concentrate of claim 2, wherein said diluent oil has a Noack volatility of less than about 35 mass %.

4. A concentrate of claim 3, wherein said diluent oil has a Noack volatility of less than 32 mass %.

5. A concentrate of claim 1, wherein the concentrate has a $kv_{100}$ of from about 300 to about 2500 cSt.

6. A concentrate of claim 1, wherein the VI improver is a copolymer of ethylene and another α-olefin (OCP).

7. A concentrate of claim 6, wherein the VI improver is an amorphous OCP having an ethylene content of less than 60 mass %, based on the total mass of OCP.

8. A concentrate of claim 1, wherein the VI improver is selected from the group consisting of homopolymers and copolymers of diolefins containing from about 4 to 12 carbon atoms, copolymers of one or more conjugated diolefins containing from about 4 to 12 carbon atoms and one or more monoalkenyl aromatic hydrocarbons containing from about 8 to 16 carbon atoms, and hydrogenated, functionalized and hydrogenated and functionalized derivatives thereof.

9. A concentrate of claim 8, wherein the VI improver is selected from the group consisting of linear random polymers, linear tapered polymers, linear block copolymers, random star polymers, tapered star polymers and block star polymers.

10. A concentrate of claim 1, wherein the diluent oil is a mixture of a Group I oil and at least one Group II and Group III oil.

11. A concentrate of claim 1, containing from about 4 to about 50 mass % of VI improver.

12. A concentrate of claim 1, wherein the diluent oil has a CCS at −35° C. of less than 3300 cPs.

13. A concentrate of claim 12, wherein the diluent oil has a CCS at −35° C. of less than 3000 cPs.

14. A concentrate of claim 13, wherein the diluent oil has a CCS at −35° C. of less than 2500 cPs.

15. A concentrate of claim 1, wherein the diluent oil has a sulfur content of less than about 1 mass %.

16. A concentrate of claim 1, wherein the diluent oil has a sulfur content of from about 0 to about 0.3 mass %.

17. A concentrate of claim 1, wherein the diluent oil has a saturate content of greater than about 90%.

18. A concentrate of claim 1, wherein the diluent oil has a viscosity index (VI) of at least about 85.

19. A concentrate of claim 1, wherein said VI improver is a multifunctional VI improver.

* * * * *